United States Patent [19]

Moravec et al.

[11] 4,354,418

[45] Oct. 19, 1982

[54] AUTOMATIC NOTE ANALYZER

[75] Inventors: John V. Moravec, Willow Springs; William P. Carlson, Hanover Park; Michael J. McGowan, Lombard, all of Ill.

[73] Assignee: Nuvatec, Inc., Lombard, Ill.

[21] Appl. No.: 180,860

[22] Filed: Aug. 25, 1980

[51] Int. Cl.[3] ..... G10G 7/02

[52] U.S. Cl. ..... 84/454; 84/DIG. 18; 324/78 D

[58] Field of Search ..... 84/454, DIG. 18; 324/78 D, 78 R; 179/1 SC, 1 SA

[56] References Cited

U.S. PATENT DOCUMENTS

| | | | |
|---|---|---|---|
| 4,004,096 | 1/1977 | Bauer et al. | 179/1 SC |
| 4,028,985 | 6/1977 | Merritt | 84/454 |
| 4,123,704 | 10/1978 | Johnson | 324/78 D |
| 4,151,775 | 5/1979 | Merriman | 84/1.01 |
| 4,217,808 | 8/1980 | Slepian et al. . | |
| 4,253,373 | 3/1981 | Foerst | 84/DIG. 18 |
| 4,258,423 | 3/1981 | Lane et al. | 324/78 D |
| 4,280,387 | 7/1981 | Moog | 84/454 |
| 4,313,361 | 2/1982 | Deutsch | 84/454 |

FOREIGN PATENT DOCUMENTS

| | | | |
|---|---|---|---|
| 54-109886 | 8/1979 | Japan | 84/454 |
| 1445855 | 8/1976 | United Kingdom . | |

*Primary Examiner*—J. V. Truhe
*Assistant Examiner*—Forester W. Isen
*Attorney, Agent, or Firm*—Hume, Clement, Brinks, Willian & Olds, Ltd.

[57] ABSTRACT

An automatic note analyzer is disclosed which automatically generates and displays a note signal indicative of the musical note corresponding to an input signal. The disclosed analyzer operates to measure the period of the input signal on a regular basis. According to one aspect of the invention, the measured period is compared with a predetermined window representative of the expected value of the measured period. Measured periods which do not fall within the predetermined window are rejected. According to a second feature, measured signals representative of the period of the input signal are averaged in order to increase the stability of the analyzer. The disclosed analyzer operates in two modes: an absolute mode, and a transposer mode. In the absolute mode the displayed note value is determined with reference to an absolute pitch. In the transposer mode, the displayed note value is determined with reference to a relative pitch which can be readily adjusted as needed.

15 Claims, 6 Drawing Figures

30
OUTPUT SIGNAL
32
75
270
OUTPUT LOGIC
260
290
THRESHOLD SIGNAL
INTEGRATOR
280
292
210
PREAMPLIFIER WITH A.G.C.
230
240
VARIABLE FREQUENCY FILTER
310
SAWTOOTH GENERATOR
302
312
320
340

AUTOMATIC NOTE ANALYZER

BACKGROUND OF THE INVENTION

The present invention relates to a note analyzer which automatically determines the musical note of a musical tone and displays this note as an aid in the tuning of musical instruments and the like.

Note analyzers of various types are known to the art. Generally, these note analyzers operate to provide a visual indication of the musical note which corresponds to the tone being analyzed. For example, one approach of the prior art utilizes a spinning disc which is strobed at a rate which varies in accordance with the frequency of the tone being analyzed. This approach relies on the user to vary the rotation rate of the disc manually until the strobe rate matches the rotation rate of indicia on the disc. This approach suffers from the disadvantage that it requires considerable user intervention and is therefore not automatic in operation. Furthermore, it may be difficult for a user to find the proper adjustment for the rate of rotation of the disc if the approximate note of the tone is not known in advance.

SUMMARY OF THE INVENTION

The present invention is directed to an improved, fully automatic note analyzer which is capable of accurately indicating the note of an input musical tone for a wide range of musical tones.

According to a first aspect of this invention, an analyzer is provided with means for receiving an input signal indicative of a musical tone and means for automatically generating and updating a measured signal which is indicative of a parameter, such as the period for example, of the input signal. In addition, means are provided for automatically generating a target signal as a function of the measured signal. This target signal is indicative of the expected value of the parameter, and is used to evaluate later measured values of the measured signal. That is, later measured values of the measured signal are stored only if they match the target signal. Stored measured signals are then used to modify the target signal. Preferably, the measured signal is classified as matching the target signal whenever the measured signal is substantially equal to selected binary factors of the target signal, where the term "binary factor" denotes any number which can be expressed as $2^N$, where N is an integer.

This first aspect of the invention provides improved rejection of spurious signals, since the target value is used to screen out measured signals which do not fall within the expected range. Thus, the first aspect of the invention contributes to increased accuracy and reliability. In addition, by considering selected binary factors of the target signal as matches, use is made of certain harmonic and subharmonic signals which can be interpreted unambiguously, thereby improving the utilization of the measured signal. In effect, the note analyzer of this invention can be constructed to recognize certain harmonics and subharmonics, and to treat them as such rather than simply ignoring them as erroneous signals.

According to a second aspect of the invention, a note analyzer is provided with means for generating a sequence of measured signals, each of which is indicative of a parameter, such as period, which is related to the tone of an input signal at a respective time. In addition, means are provided for automatically averaging a plurality of measured signals, including the most recent measured signal, to generate an averaged measured signal. This averaged measured signal is then used to generate a note signal which is indicative of the corresponding musical note, which is then displayed.

This second aspect of the invention provides increased stability to the note analyzer. Because an averaged value of the measured signal is used rather than an instantaneous value, the displayed note signal changes more slowly than otherwise would be the case. This second aspect of the invention cooperates advantageously with the first aspect discussed above, in that both aspects contribute to stable operation of the note analyzer and to increased rejection of erroneous measurements.

According to a third aspect of the invention, a note analyzer is provided with means for generating a plurality of note signals, each of which is indicative of the musical note corresponding to an input signal at a given time. In addition, means are provided for generating and storing a correction signal indicative of the deviation of a first note signal from a stored reference value. This correction value is then combined with a later note signal to generate a transposed note signal indicative of the musical tone of the later note signal with reference to the first note signal.

This third aspect of the invention is especially useful in connection with the tuning of musical instruments, where one instrument is to be tuned to the pitch of another instrument. For example, it is often desirable to tune a violin or guitar such that the violin or guitar is in tune with a piano. In this case, the piano can be used to generate the input signal which corresponds to the first note signal, and the violin or guitar can be used to generate the input signal corresponding to the later note signal. In this way, the transposed note signal of the violin or guitar is determined in the relative pitch of the piano, rather than in absolute pitch.

The invention itself, together with further objects and attendant advantages, will best be understood by reference to the following detailed description taken in connection with the accompanying drawings.

DETAILED DESCRIPTION OF THE PREFERRED EMBODIMENT

Figure 1:
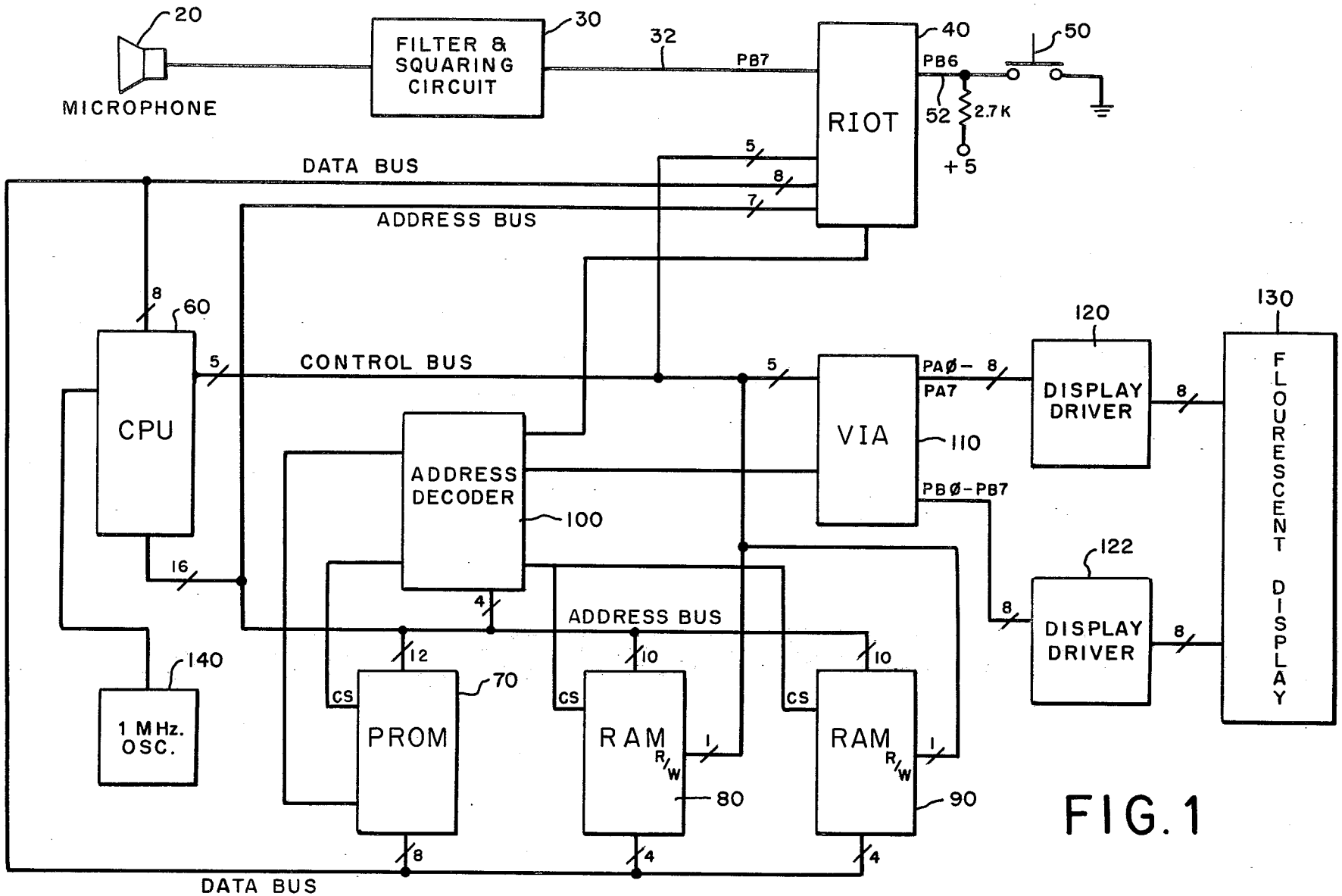
FIG. 1 is a block diagram of the presently preferred embodiment of the automatic note analyzer of the present invention.

Referring now to the drawings, FIG. 1 presents a block diagram of the presently preferred embodiment of this invention. The embodiment of FIG. 1 includes a microphone 20 which generates an electrical signal which is applied to a filter and squaring circuit 30. This filter and squaring circuit 30 does not form a part of the present invention as such, and will not, therefore, be described in detail here. However, a detailed description of the circuit 30 is provided in a co-pending U.S. patent application Ser. No. 180,626, filed Aug. 25, 1980, assigned to the assignee of the present invention. This co-pending application is entitled "Filter Circuit" and names Daniel G. Prysby as the inventor. Reference should be made to this application for a detailed understanding of the filter and squaring circuit 30. Here, it is enough to state that the circuit 30 processes the electrical signal received from the microphone 20 to generate an input signal on the line 32. This filter circuit 30 serves to filter out undesired high frequency harmonics, and to provide a digital input signal on the line 32 substantially corresponding in period to the fundamental period of the electrical signal generated by the microphone 20. As will be explained below, the input signal on line 32 may on occasion have a period equal to a subharmonic or a harmonic of the fundamental period rather than to the fundamental period itself. However, the object of the filter circuit is to produce an input signal on line 32 which as nearly as possible corresponds in period to the period of the fundamental tone of the microphone signal.

Figure 5:
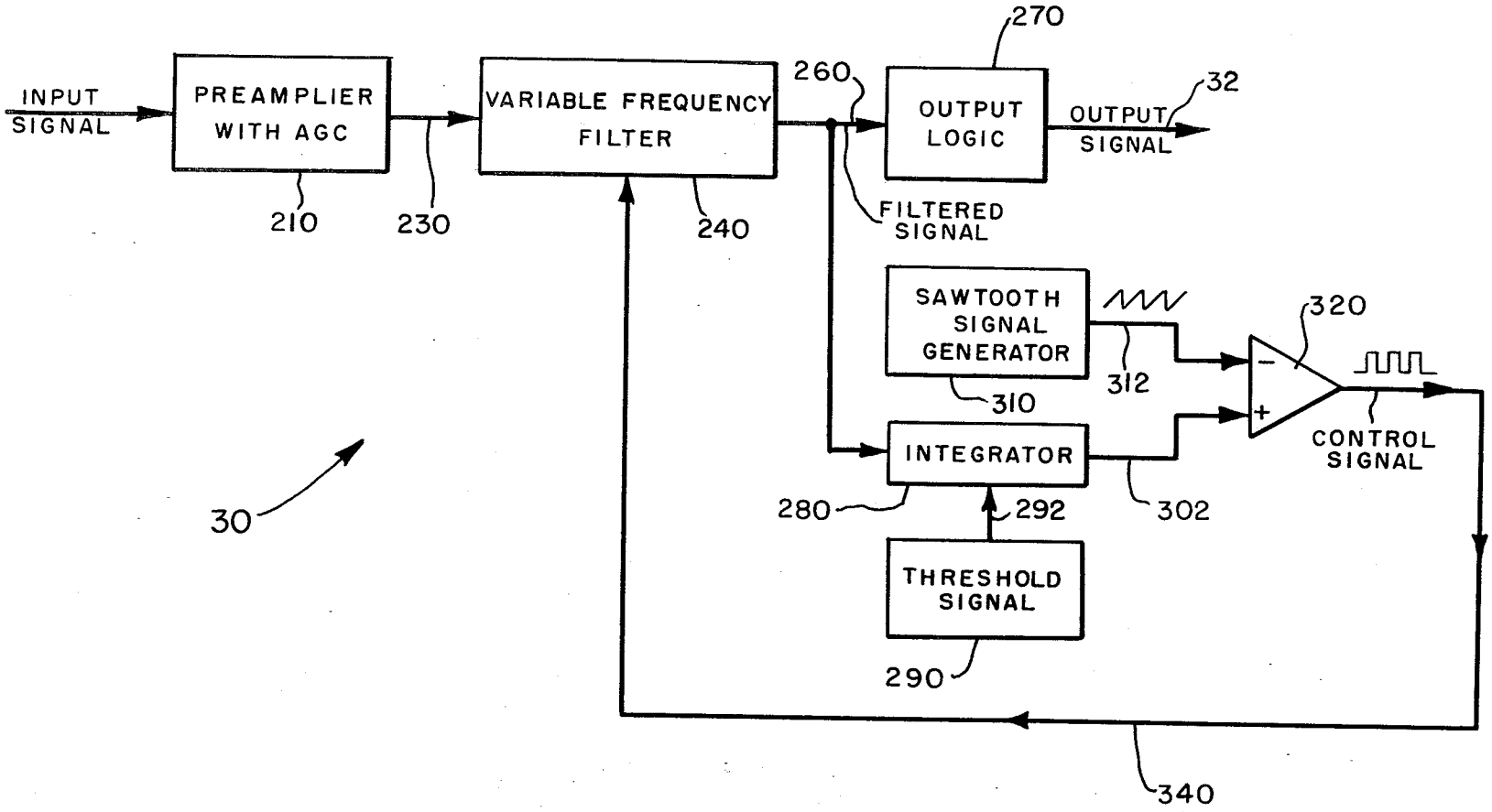
FIG. 5 is a block diagram of a preferred embodiment of the circuit 30.
Figure 6:
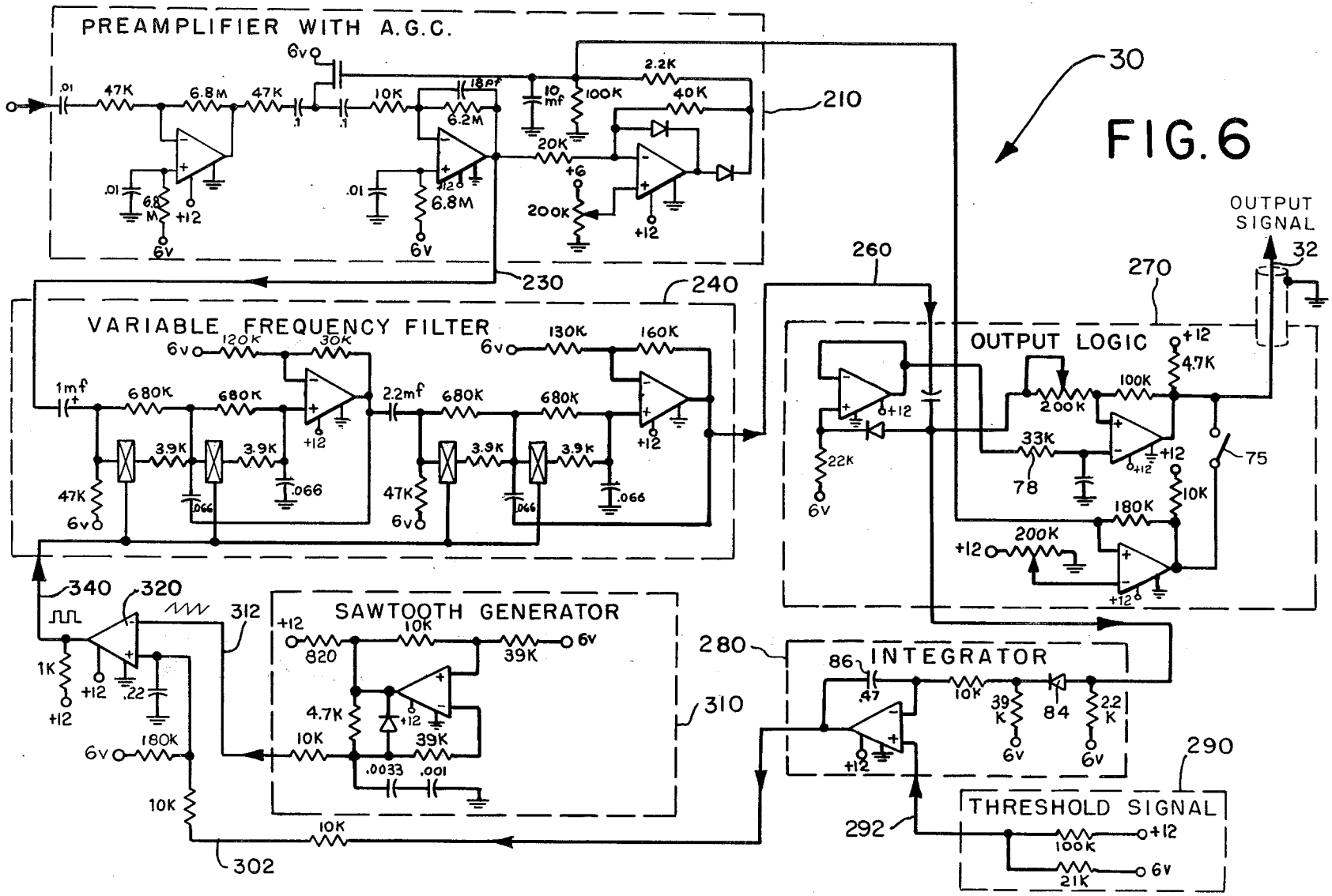
FIG. 6 is a detailed circuit diagram of the circuit 30.

FIGS. 5 and 6 present details of the circuit 30. FIG. 5 provides a block diagram of the presently preferred embodiment of the filter circuit 30. As shown in FIG. 5, this filter circuit 30 includes a preamplifier 210 which provides automatic gain control. This preamplifier 210 accepts an input signal which is preferably the electrical signal generated by the microphone 20. The preamplifier 210 acts to amplify this input signal and to bring the amplified input signal within a preferred amplitude range.

The output of the preamplifier 210 is supplied via line 230 to a variable frequency filter 240. The construction of this variable frequency filter 240 is shown in detail in FIG. 6. Here it is enough to state that the filter 240 accepts the amplified input signal on line 230 and produces a filtered signal on line 260. In this preferred embodiment, the filter 240 is a low-pass filter having a variable rolloff frequency. The instantaneous value of the rolloff frequency is determined by a control signal which is applied to the filter 240 by means of the control signal line 340. By varying the rolloff frequency of the filter 240, this filter can be adjusted to selectively attenuate high frequency components of the amplified input signal which have a frequency above the variable rolloff frequency.

The filtered signal generated by the filter 240 is applied to an output logic circuit 270 which shapes the filtered signal to form a two-state digital signal suitable for input to a microprocessor. In addition, the filtered signal on line 260 is applied as an input to an integrator 280 which generates an intermediate signal on line 302. This intermediate signal is related to the difference between the peak amplitude of the filtered signal on line 260 and the threshold signal generated on line 292 by the circuit 290. This intermediate signal on line 302 is applied to the non-inverting input of a voltage comparator 320. A sawtooth signal generator 310 is provided which provides a sawtooth signal on line 312 to the inverting input of the voltage comparator 320.

The voltage comparator 320 acts to generate the control signal on line 340 which is applied to the variable frequency filter 240 to determine the filter characteristics of the filter 240. This control signal 340 is a two-state digital signal which alternates between two voltages. The control signal on line 340 is held in the low voltage state by the voltage comparator 320 when the amplitude of the sawtooth signal on line 312 exceeds the amplitude of the intermediate signal on line 302. Conversely, the control signal on line 340 is held in the high voltage state when the intermediate signal on line 302 is greater than the sawtooth signal on line 312. Because the sawtooth signal provides a progressive ramp, the percentage of the total time that the control signal is in the high voltage state (that is, the duty cycle of the control signal 340) is determined by the amplitude of the intermediate signal on line 302.

FIG. 6 presents a detailed circuit diagram of the presently preferred embodiment of the circuit 30, in which the reference numerals of FIG. 5 have been applied to facilitate understanding.

The input signal on line 32 is applied as an interrupt to the interface unit 40, which is in turn coupled to a CPU 60. In addition, a manually operated switch 50 is provided to control a second signal which is applied to the interface unit 40 via line 52. As will be explained below, this manually operated switch 50 is used to select the mode of operation of the automatic note analyzer of FIG. 1.

Standard integrated circuit components are included in the embodiment of FIG. 1 to form a microcomputer system. This system includes the CPU 60, a programmable read-only memory circuit 70, random access memory circuits 80,90, as well as an address decoder 100. An interface circuit 110 is provided which controls two display driver circuits 120,122. These driver circuits 120,122 provided multiplexed control over the display circuit 130. In addition, a one megahertz oscillator 140 is coupled to the CPU to provide a time base for period measurement operations to be described below.

In FIG. 1 the number of parallel conductors included in each of the buses is indicated by a numeral adjacent a slash mark. For example, FIG. 1 indicates that eight parallel conductors are routed between the PROM 70 and the data bus, while four parallel conductors are routed between each of the RAM's and the data bus. Table 1 indicates the integrated circuits used to implement the preferred embodiment of FIG. 1.

TABLE 1

| Reference No. | Manufacturer | Circuit Type No. |
|---|---|---|
| 40 | Rockwell | 6532 |
| 60 | Rockwell | 6502 |
| 70 | Motorola | 2716 |
| 80 | Motorola | 2114 |
| 90 | Motorola | 2114 |
| 100 | Texas Instruments | 74LS138 |
| 110 | Rockwell | 6522 |
| 120 | Dionics | DI514 |
| 122 | Dionics | DI514 |
| 130 | Futaba | 5LY01 |

In this preferred embodiment the PROM 70 stores two kilo-bytes, each byte eight bits in length, and the RAM's 80,90 each store one kilo-byte, each byte four bits in length.

The circuit of FIG. 1 is a computer based circuit which receives an interrupt input signal via line 32 and a switch signal via line 52 and processes these signals to generate a digital output on display 130. As will be explained below, this system operates to analyze the musical note corresponding to the input signal, and to display this note digitally on the display 130. In this preferred embodiment the precision of the measured note is indicated in cents, or hundredths of a tone. Thus the display 130 indicates the nearest note (in semitones)

corresponding to the input signal as well as a number between −50 and +50 which indicates the number of cents by which the input signal deviates from the displayed note.

Figure 2:
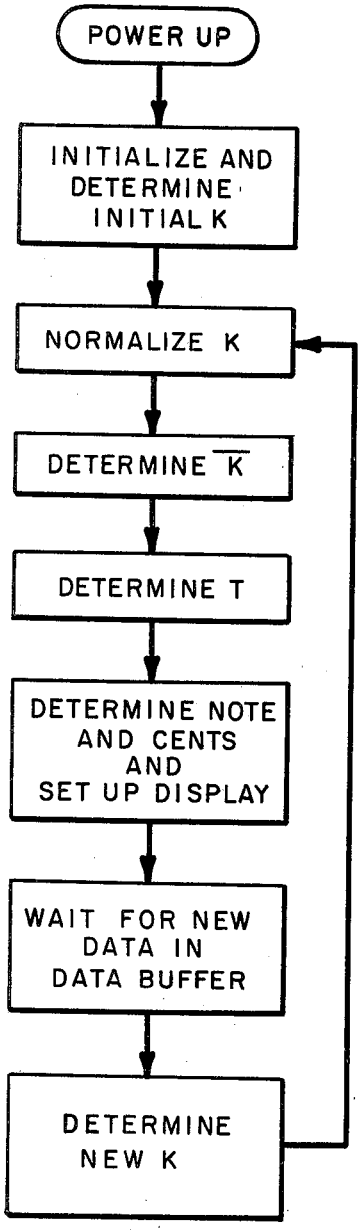
FIG. 2 is a flowchart of the initialization sequence and the main control sequence of the embodiment of FIG. 1.
Figure 4:
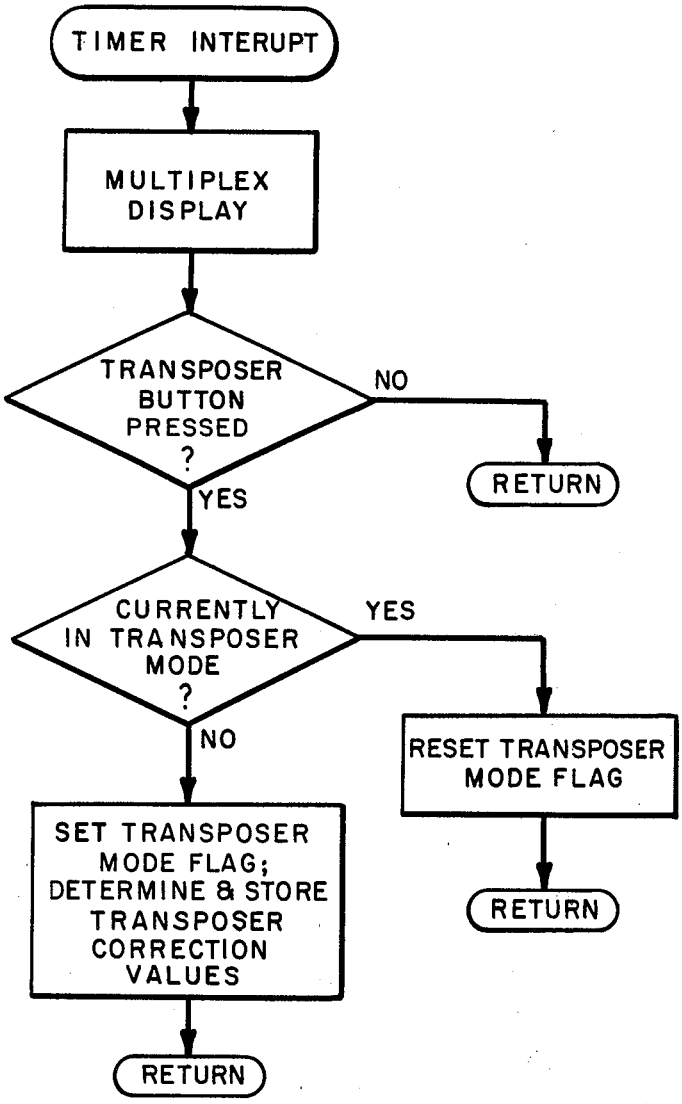
FIG. 4 is a flowchart of the timer interrupt routine of the embodiment of FIG. 1.
Figure 3:
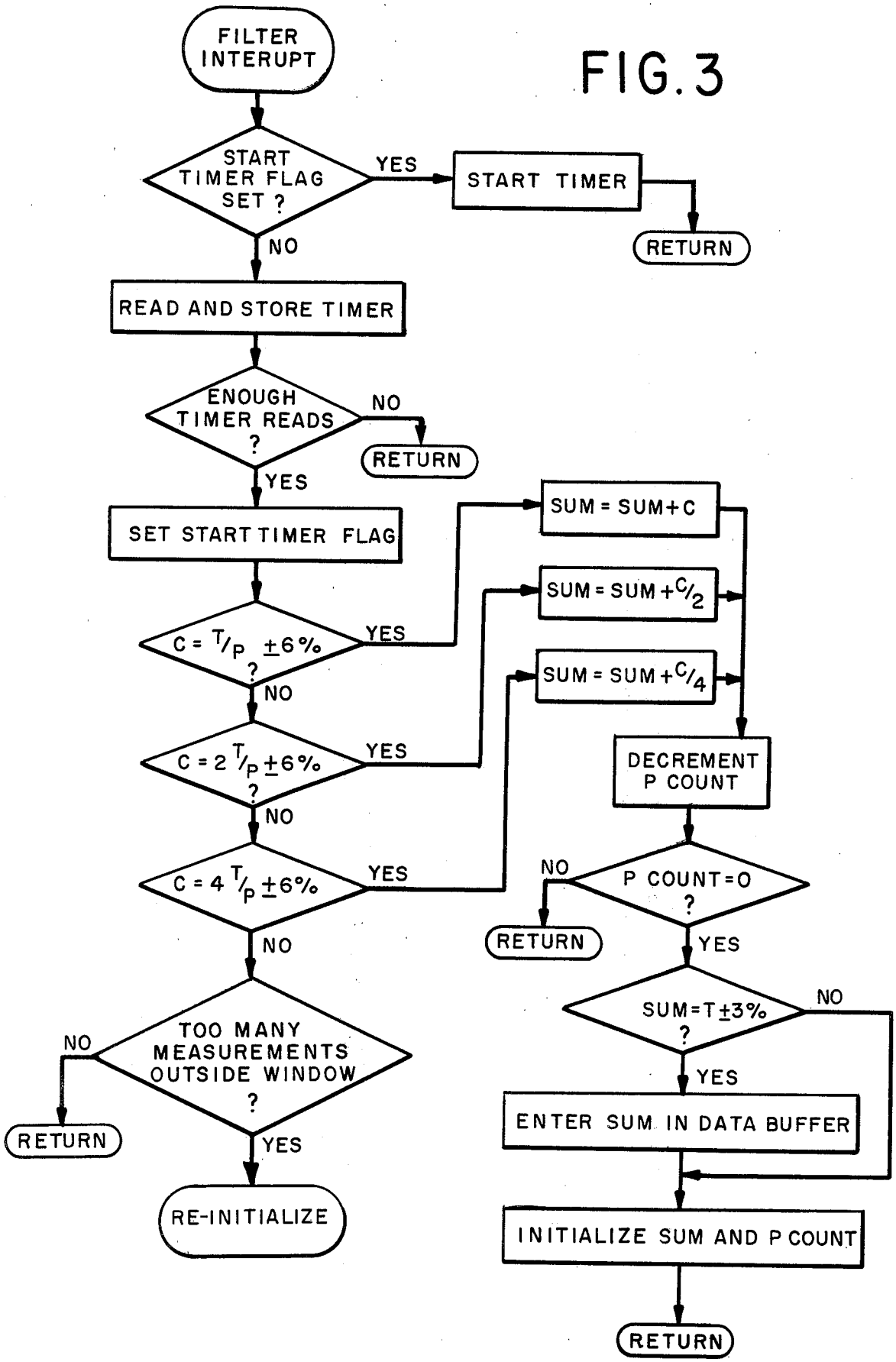
FIG. 3 is a flowchart of the input signal interrupt routine of the embodiment of FIG. 1.

Turning now to FIGS. 2-4, the computer program which processes the input signals on lines 32 and 52 will now be described. A complete listing of the computer program flowcharted in FIGS. 2-4 can be found in U.S. patent application File Ser. No. 180,860 on file with the U.S. Patent and Trademark Office.

Turning now to FIG. 2, the program of this preferred embodiment begins with an initialization routine. In this initialization routine various hardward parameters are initialized and software variables are set to initial values. Then a set of data counts is measured and stored. As used herein, the term "data count" will be used to denote a time measurement corresponding to the number of oscillator pulses counted within a measurement period extending over P consecutive cycles of the input signal on line 32.

The CPU 60 includes a counter which is decremented by the oscillator 140 at the rate of one million decrements per second. In this embodiment a data count corresponds to the number of times this counter is decremented within the measurement period. The measurement period is determined by the input signals applied via line 32 to the interface unit 40. In the simplest case, which corresponds to the situation immediately following power up, the variable P is equal to 1 and the measuring period extends between two adjacent interrupts on line 32. As explained previously, the circuit 30 serves to provide an interrupt signal substantially once per cycle of the fundamental period of the electrical signal generated by the microphone 20. Thus, each data count will, during the first execution of the initialization sequence, correspond to a number indicative of the fundamental period of the input signal. During the initialization sequence, a number of sequential data counts equal to N+5 are measured and stored. During the first execution of the initialization routine N equals 1 and thus thirteen consecutive data counts are stored.

These data counts are than analyzed to determine whether a consistent pattern can be found. In particular, the program attempts to find N separate data counts which are equal to one another, with a tolerance of about 3%. If N consistent data counts cannot be found, then the initialization procedure is reexecuted, and another set of data counts is measured and examined for consistency. Once N consistent data counts are found, then the variable K is set equal to the sum of these N data counts. Thus, K is a variable which corresponds to the sum of a selected number of N consistent data counts. Expressed algebraically,

| | |
|---|---|
| Data Count = $P \times C_1$; | (Eq. 1) |
| $K = N \times$ Data Count; and | (Eq. 2) |
| $K = N \times P \times C_1$; | (Eq. 3) |

where $C_1$ equals the period of the input signal, that is the time delay between adjacent interrupts on line 32; P equals the number of inputs ignal cycles included in the data count measurement period, and N equals the number of measurement periods which are summed to determine K. Of course, $C_1$ is not actually a constant value and therefore the equalities of Eq. 1, 2 and 3 are only approximate. Thus, the variable K is a function of three variables: (1) the time delay between adjacent interrupts on line 32, (2) the duration of the measurement period of a single data count in terms of the number of interrupts which occur between the starting and the stopping of the counter, and (3) the number of data counts which are summed to determine K. In this preferred embodiment, P can take on any of the following values: 1, 2, 4, 8, 16 or 32. When P equals 32, the measurement period is stopped on the 32nd interrupt following the start of the counter. In this preferred embodiment, N can take on any one of the following values: 1, 2, 4, 8, 16. Thus, when N equals 16, 16 separate data counts are summed to form the variable K. The variables N and P are used to control the data collection process as a function of the measured period of the interrupt signals on line 32.

Once an initial value for the variable K has been determined, K is then normalized to place it within a desired range. In this preferred embodiment, the desired range is between 0135CD (hexadecimal) and 009AE6 (hexadecimal). The variable K is normalized to fall within the range described above by multiplying or dividing it (as necessary) by factors of 2 until it falls within the desired range. Furthermore, at least one of the variables N and P is adjusted each time the variable K is normalized in order to adjust the measurement procedure to the prevailing measured period.

Thus, for example, if the value of K is lower than the minimum acceptable value, K is doubled and then either N or P is doubled as well. Doubling either N or P will cause the next calculated K to be approximately double its previous value, thereby reducing the need for further normalization of K. If K is still below the minimum acceptable value after being doubled, it is then doubled again, and once again either the variable N or the variable P is doubled as well. On the other hand, if K is greater than the maximum allowed value, then the value of K is divided by two, and one of the variables N or P is divided by two as well. In this way the variable K is normalized to fall within the desired range, and the variables N and P are adjusted to increase or decrease K as appropriate in the next pass through the program.

The normalized value of K is then averaged with previously calculated values of K to smooth out fluctuations. In this preferred embodiment the current value of K is summed with the fifteen immediately preceding values of K and the sum is divided by sixteen to generate $\overline{K}$. $\overline{K}$ is then used in all further processing.

The first step in this further processing is to set the variable T equal to the $\overline{K}$ divided by N. T is a measure of the expected data count for a measurement period lasting over P cycles of the input signal. The variable T is used as a target signal to define a window which is used to screen incoming data to ascertain whether that incoming data is consistent with previously measured values of the data count, and thereby to screen out erroneous measurements.

In addition, $\overline{K}$ is used to determine the musical note corresponding to the input signal on line 32. In particular, $\overline{K}$ is compared with a look-up table which lists values for $\overline{K}$ at the halfway points between adjacent semitones. In this way the semitone closest to $\overline{K}$ is determined. In addition, the difference between $\overline{K}$ and the table entry for the nearest semitone is determined as the fractional deviation of $\overline{K}$ from the nearest semitone in cents. The entire look-up table is arranged in terms of a predetermined reference pitch, such as International Concert Pitch in which A above middle C corresponds to 440 Hz.

This preferred embodiment can operate in one of two modes. In the first mode (the absolute mode) the semitone and cents determined in the previous step are then loaded into a display buffer for display. In this mode the period of the input signal on line 32 is analyzed in terms of absolute pitch based on International Concert Pitch. In the second mode of operation (the transposer mode) the semitone and cents value obtained from the look-up table are modified by a variable amount. As will be explained below, transposer correction values for both the semitone and for the cents value are stored when the analyzer is operating in the transposer mode. When in the transposer mode these correction values are added to the semitone value and to the cents value, respectively. This effectively transposes the note measurement to the pitch corresponding to the correction value. In the transposer mode, it is these transposed values of the semitone and the cents value which are loaded into a display buffer for later display.

Once the display buffer has been loaded, the program then waits for a new data count to be entered into the data buffer. The entry of new data counts into the data buffer will be explained below in connection with FIG. 3. Once a new data count has been entered in the data buffer, the program then determines a new value for the variable K by summing N separate data counts. Then the program branches back to normalize K, to determine the averaged value $\overline{K}$ and the variable T as explained above. Thus the program continues to loop, updating the note and cents display with each pass through the main loop of the program.

Turning now to FIG. 3, the interrupt service routine for interrupts on line 32 is there flowcharted. In this routine the Start Timer Flag is first checked. This flag indicates whether the timer is to be started on the next interrupt. If the flag is set, the computer simply starts the timer (that is, initializes the timer and causes it to be decremented at a rate of one megahertz) and returns from the service routine.

If the timer flag is not set, the program reads and stores the instantaneous value in the timer and then checks to see whether enough values of the timer have been read. The number of timer values to be read varies as a function of the variable P such that if P is equal to 1 or 2 exactly one reading of the timer is sufficient, if P equals 4 or 8 then two consecutive readings of the timer are required, and if P is 16 or 32 then three readings of the timer are required. In the following discussion $C_1$ will be used to denote the elapsed time count between the start of the timer and the next interrupt, $C_2$ will be used to denote the elapsed timer count between the start of the timer and the second interrupt, and $C_3$ will be used to denote the elapsed timer count between the start of the counter and the third interrupt. The Start Timer Flag is then set to begin collection of another set of data with the next interrupt.

A number of tests are then performed on $C_1$ (and on $C_2$ and $C_3$ as well if they have been measured) to determine whether or not any of these variables falls within the expected range. In the flowchart of FIG. 3 these comparisons are indicated for the variable C. It should be understood that each of the three comparisons of FIG. 3 related to the variable C is in fact performed for each of the variables $C_1$, $C_2$, and $C_3$ which has been measured. The first of these tests is to determine whether C is equal to $T/P \pm 6\%$. It will be recalled that T is the anticipated data count for measurement period extending over P interrupts. Thus, if C is equal to T/P, then C falls within the anticipated window. In this case a running sum is incremented by an amount equal to the value of C.

If C is not equal to T/P it is then compared with 2T/P. If C is substantially equal to 2T/P then C is approximately twice the anticipated amount. This corresponds to detection of the subharmonic having a period twice that of the expected period. The computer is programmed to recognize this subharmonic and to increase the running sum by an amount equal to C/2.

Finally, C is compared with 4T/P. If C is found to be approximately equal to 4T/P then the sum is incremented by amount equal to C/4. This corresponds to detection of the subharmonic having a peiod four times that of the expected period and recognition by the program that the variable C, though not equal to the anticipated fundamental tone, is in fact equal to the period of a subharmonic. In this case the value of C is divided by four in order that it may be properly treated as a subharmonic before it is added to the running sum.

When $C_2$ and $C_3$ are compared with T/P, 2T/P and 4T/P the program is effectively searching to determine whether $C_2$ or $C_3$ corresponds to a harmonic of the expected period. For example, if $C_2$ is approximately equal to T/P, then the program interprets $C_2$ as a first harmonic of the anticipated fundamental and augments the sum by an amount equal to $C_1$. In this way both harmonics and subharmonics which have a period differing from that of the fundamental by a binary factor are recognized as such and incorporated in the period measurement. Such harmonics and subharmonics can be interpreted unambiguously, because they differ from the fundamental by one or more octaves, and therefore correspond to the same note. Other harmonics and subharmonics are not so unambiguous and are therefore rejected. For example, a harmonic with a period $\frac{1}{3}$ that of the fundamental could in fact correspond to a note different from that of the fundamental.

If, however, no match is obtained with either T/P, 2T/P or 4T/P, then the program increments a count of measurements outside the anticipated window. When an excessive number of consecutive failures to match the measured elapsed counter value with the anticipated window are sensed, then the program re-initializes, effectively starting over in an attempt to determine an appropriate value of T.

Assuming that the program finds a match between T and $C_1$, $C_2$ or $C_3$, as explained above, then the variable PCOUNT is decremented and checked. If PCOUNT is equal to zero from decrementing, the sum is then compared with T, the anticipated value of the sum. Generally, the sum will be equal to $T \pm 3\%$ and in this case the sum will be entered in the data buffer as a new data count for processing in the main control loop as described above. The running sum and the variable PCOUNT are then initialized for the next pass through the interrupt service routine of FIG. 3, and control is returned to the main loop.

FIG. 4 shows a second interrupt service routine which services a timer interrupt timed to interrupt the program every two milliseconds. This timer interrupt is serviced by first multiplexing the display in order to update the display to conform to the display buffer. In this preferred embodiment the note value and the cents value are displayed as characters. The note value is one of the 12 semitones and the cents value is an integer between $-50$ and $+50$. In alternate embodiments it may be preferable to display the cents value in an analog or pseudo-analog form. For example, a 100 element row of discrete digital indicators (such as LED's or LCD's) could be used with one half of the row used to indicate negative cents and the other half used to indicate positive cents. Such pseudo-analog displays can improve readability when the cents value is changing rapidly.

The transposer switch 50 is then checked. If the switch 50 is not in the depressed state, control is then returned to the main loop from the timer interrupt. If, on the other hand, the switch 50 is pressed the program checks to determine whether the Transposer Mode Flag is set or reset. If the Transposer Mode Flag is set, indicating that the analyzer is currently operating in the transposer mode, then the Transposer Mode Flag is reset and control is returned from the interrupt service routine. If, on the other hand, the Transposer Mode Flag is reset, then the Transposer Mode Flag is set to indicate that the analyzer is to operate in the transposer mode.

After the Transposer Mode Flag is set, two transposer correction values are determined and stored for later use by the program. This is done by comparing the current value of $\overline{K}$ with the table entry for the note A. The difference between $\overline{K}$ and the table entry for the note A is stored for later use in the transposer mode of operation. For example if $\overline{K}$ is 35 cents higher than the table entry for the note A, then the stored correction value is set to zero notes and 35 cents. Similarly, if the stored value of $\overline{K}$ is one note and 5 cents lower than the table entry for the note A, then the correction value is set equal to $-1$ note and $-5$ cents. After these correction values are determined and stored, control is then returned from the timer interrupt service routine.

From the foregoing, it should be apparent that the automatic note analyzer of this invention provides several important advantages. First, the analyzer generates a target signal (T or a multiple thereof in the preferred embodiment described above) which is used as a window to filter out erroneous measurements such that only period measurements which fall within the designated window are processed further. This feature of the invention screens out inaccurate period measurements, due to noise or the like, and thereby contributes to more stable and reliable operation of the analyzer.

Second, the analyzer utilizes a sophisticated comparison between the measured signal and T to determine whether there is a match. Instead of rejecting a measured period which equals $\frac{1}{2}$T or 2T as being outside the window, the preferred embodiment described above recognizes such measured periods as harmonics or subharmonics and treats them accordingly as falling within the window. In this way the analyzer interprets the input signal in a sophisticated manner to make use of data that might otherwise be rejected as falling outside the window.

Third, the analyzer described above utilizes an average of recently measured periods to determine the note signal to be displayed. By displaying an averaged measured period rather than the instantaneous measured period, the stability and precision of the displayed note signal is increased.

Fourth, the analyzer described above provides a transpose mode of operation which is particularly useful and easy to implement. In the transpose mode, the analyzer remembers a designated tone and then displays the note and cents value of later tones using the designated tone as a definition of the note A above middle C. This facilitates the tuning of multiple instruments in the case where one of the instruments is not to be retuned. The transpose mode allows the pitch of the analyzer to be easily redefined from absolute concert pitch to the relative pitch of the instrument which will not be retuned. Because the transpose function is implemented after the note value and the cents value of the input signal have already been measured, only a simple algebraic combination is required.

Because the analyzer of this embodiment is implemented as a programmed microcomputer, it is particularly reliable and inexpensive to manufacture. Furthermore, it is fully autmomatic in operation.

Of course, it should be understood that various changes and modifications to the preferred embodiment described above will be apparent to those skilled in the art. Such changes and modifications fall within the spirit and scope of the present invention. It is therefore intended that all such changes and modifications be covered by the following claims.

We claim:

1. An automatic note analyzer comprising:

means for receiving an input signal indicative of a musical tone;

means for automatically and repeatedly generating and updating a sequence of measured signals, each measured signal indicative of the measured value of a predetermined parameter of the input signal at a respective time;

means for automatically generating a target signal in response to the sequence of measured signals such that the target signal is indicative of an average of the measured value of the predetermined parameter of the input signal during a first time period;

means for automatically storing a signal corresponding to one of the measured signals at a second time subsequent to the first time period, only when said one of the measured signals deviates from a signal corresponding to the target signal by less than a predetermined amount; and means for automatically modifying the target signal in response to the stored signal by an amount less than the difference between the target signal and the stored signal in order to cause the target signal more nearly to equal the stored signal.

2. The invention of claim 1 wherein the predetermined parameter of the input signal is proportional to the period of the input signal.

3. The invention of claim 1 wherein the storing means operates to store the signal corresponding to the measured signal only when the measured signal is substantially equal to one of a plurality of selected binary factors of the target signal.

4. The invention of claim 1 wherein the storing means operates to store the signal corresponding to the measured signal when the measured signal is substantially equal to $\frac{1}{2}$, 1, 2 or 4 times the target signal.

5. An automatic note analyzer comprising:

means for receiving an input signal indicative of a musical tone;

means for automatically and repeatedly generating a sequence of measured signals each measured signal indicative of the period of the input signal at a respective time;

means for automatically generating a target signal in response to a plurality of measured signals such that the target signal is indicative of an average value of the measured signal during a first time period;

means for automatically storing a signal corresponding to the value of the measured signal at a second time, subsequent to the first time period, only when the second value of the measured signal deviates from a signal corresponding to the target signal by less than a first amount; and means for automatically modifying the target signal in response to the stored signal by an amount less than the difference between the target signal and the stored signal to cause the target signal to more nearly equal the stored signal.

6. The invention of claim 5 wherein the storing means operates to store the signal corresponding to the second value of the measured signal when the second value is substantially equal to $\frac{1}{2}$, 1, 2 or 4 times the target signal.

7. The invention of claim 5 wherein the storing means operates to store the signal corresponding to the second value of the measured signal when the second value is substantially equal to one of a plurality of selected binary factors of the target signal.

8. An automatic note analyzer comprising:

means for receiving an input signal indicative of a musical tone;

means for automatically generating a plurality of note signals including first and second note signals, each note signal indicative of the tone of the input signal at a respective time, wherein the first note signal is generated at a first time and the second note signal is generated at a second time, subsequent to the first time;

means for generating and storing a correction signal indicative of the deviation of the first note signal from a stored reference value;

means for automatically combining the correction signal with the second note signal to generate a transposed note signal indicative of the musical tone of the second note signal with reference to the first note signal; and means for displaying the transposed note signal.

9. The invention of claim 8 wherein each of the plurality of note signals has a precision greater than one semitone.

10. The invention of claim 8 wherein the combining means operates to combine the correction signal and the second note signal algebraically.

11. The invention of claim 8 wherein the correction signal is generated as an algebraic combination of the first note signal and the stored reference value.

12. An automatic note analyzer comprising:

means for receiving an input signal indicative of a musical tone;

means for automatically generating a plurality of note signals including first and second note signals, each note signal comprising a semitone signal indicative of the nearest semitone corresponding to the input signal at a respective time and a fractional signal indicative of the fraction of a semitone by which the semitone signal deviates from the tone corresponding to the input signal at the respective time, wherein the first note signal is generated at a first time and the second note signal is generated at a second time, subsequent to the first time;

means for generating and storing a correction signal indicative of the difference between the first note signal and a stored reference value, said correction signal comprising a semitone correction signal and a fractional correction signal indicative of the number of semitones and the fractions of a semitone, respectively, by which the first note signal deviates from the stored reference value;

means for automatically combining the fractional correction signal with the fractional signal of the second note signal and the semitone correction signal with the semitone signal of the second note signal to generate a transposed note signal indicative of the musical tone of the second note signal with reference to the first note signal; and means for displaying the transposed note signal.

13. The invention of claim 12 wherein the combining means operates to combine the fractional correction signal algebraically with the fractional signal of the second note signal and to combine the semitone correction signal algebraically with the semitone signal of the second note signal.

14. The invention of claim 1 or 5 further comprising:

means for generating an output signal as a function of the target signal, said output signal indicative of a musical note corresponding to the target signal; and means for displaying the output signal as an indication of the musical note corresponding to the target signal and the musical tone.

15. An automatic note analyzer comprising:

means for receiving a digital input signal indicative of the period of a musical tone;

means for automatically and repeatedly generating a sequence of digital measured signals, each measured signal indicative of the period of the input signal and therefore the period of the musical tone at a respective time;

means for automatically determining an average of a plurality of the measured signals generated during a first time period and for generating a target signal indicative of the average;

means for comparing a subsequent one of the measured signals, generated subsequent to the first time period, with the target signal and for storing a signal corresponding to the subsequent measured signal only when the subsequent measured signal deviates from one of a plurality of selected binary factors of the target signal by less than a predetermined amount, said plurality of selected binary factors comprising $\frac{1}{2}$, 1, 2 and 4;

means for automatically modifying the target signal in response to the stored signal by an amount less than the difference between the target signal and the stored signal to cause the target signal to more nearly equal the stored signal;

means for generating an output signal as a function of the target signal, said output signal indicative of a musical note corresponding to the target signal; and means for displaying the output signal as an indication of the musical note corresponding to the target signal and the musical tone.

* * * * *

UNITED STATES PATENT AND TRADEMARK OFFICE

CERTIFICATE OF CORRECTION

PATENT NO. : 4,354,418

DATED : Oct. 19, 1982

INVENTOR(S) : Moravec et al

It is certified that error appears in the above—identified patent and that said Letters Patent is hereby corrected as shown below:

Column 4, line 30, delete "provided" and insert therefor --provide--.

Column 5, line 13, delete "hardward" and insert therefor --hardware--.

Column 5, line 61, delete "inputs ignal" and insert therefor --input signal--.

Column 6, line 48, delete "the".

Column 7, line 49, delete "time" and insert therefor --timer--.

Column 8, line 14, delete "peiod" and insert therefor --period--.

Col umn 8, line 50, delete "from" and insert therefor --after--.

Column 10, line 32, delete "value" and insert therefor --values--.

Signed and Sealed this

*Seventh* Day of *June 1983*

[SEAL]

*Attest:*

DONALD J. QUIGG

*Attesting Officer*

*Acting Commissioner of Patents and Trademarks*